US009663326B2

(12) United States Patent
Osmanbasic et al.

(10) Patent No.: US 9,663,326 B2
(45) **Date of Patent: *May 30, 2017**

(54) BRAKE DEVICE FOR A TRAVEL BODY OF AN ELEVATOR SYSTEM

(71) Applicant: Inventio AG, Hergiswil (CH)

(72) Inventors: Faruk Osmanbasic, Cham (CH); Philipp Müller, Sempach (CH); Luca Gürber, Root (CH); Benedikt Rieser, Kerns (CH); Daniel Meierhans, Lucerne (CH); Michael Geisshüsler, Lucerne (CH)

(73) Assignee: Inventio AG, Hergiswil (CH)

( * ) Notice: Subject to any disclaimer, the term of this patent is extended or adjusted under 35 U.S.C. 154(b) by 44 days.

This patent is subject to a terminal disclaimer.

(21) Appl. No.: 14/647,546

(22) PCT Filed: Nov. 15, 2013

(86) PCT No.: PCT/EP2013/073997

§ 371 (c)(1),
(2) Date: May 27, 2015

(87) PCT Pub. No.: WO2014/082878

PCT Pub. Date: Jun. 5, 2014

(65) Prior Publication Data

US 2015/0329323 A1 Nov. 19, 2015

(30) Foreign Application Priority Data

Nov. 27, 2012 (EP) ..... 12194422

(51) Int. Cl.
*B66B 5/20* (2006.01)
*B66B 5/18* (2006.01)

(52) U.S. Cl.
CPC . *B66B 5/20* (2013.01); *B66B 5/18* (2013.01)

(58) Field of Classification Search
CPC ..... B66B 5/20; B66B 5/18
(Continued)

(56) References Cited

U.S. PATENT DOCUMENTS 6,092,630 A * 7/2000 Wendel ..... B66B 5/18 187/373
6,176,350 B1 * 1/2001 Schlosser ..... B66B 5/20 187/359

(Continued)

FOREIGN PATENT DOCUMENTS

DE 29619729 U1 3/1998
DE 29619729 * 4/1998

(Continued)

*Primary Examiner* — Michael Riegelman
(74) *Attorney, Agent, or Firm* — Fraser Clemens Martin & Miller LLC; William J. Clemens

(57) ABSTRACT

A brake device for an elevator system with a travel body movable in an elevator shaft along a guide and/or brake rail brakes and retains the travel body on the rail as required. The brake device includes a control plate receiving a brake body and for positioning the brake body relative to the rail. The brake body has first and second brake elements pivoted about a common axis. The first brake element is for braking and retaining purposes when the travel body is moving along the rail in an upward direction, and the second brake element is for braking and retaining purposes when the travel body is moving along the rail in a downward direction.

17 Claims, 7 Drawing Sheets

(58) Field of Classification Search
USPC ..... 187/368
See application file for complete search history.

(56) References Cited

U.S. PATENT DOCUMENTS 6,659,230 B1 * 12/2003 Jenkins ..... B66B 5/20 187/202
8,342,294 B2 * 1/2013 Madoz Michaus ..... B66B 5/044 187/359
2002/0070082 A1 * 6/2002 Muff ..... B66B 5/22 187/356
2007/0007083 A1 * 1/2007 Husmann ..... B66B 5/20 187/366
2010/0300813 A1 * 12/2010 Kigawa ..... B66B 5/00 187/247
2011/0226560 A1 * 9/2011 Husmann ..... B66B 5/18 187/359
2012/0152663 A1 * 6/2012 Legeret ..... B66B 5/20 187/404
2013/0081907 A1 * 4/2013 Meierhans ..... B66B 5/20 187/359
2013/0081908 A1 * 4/2013 Meierhans ..... B66B 5/20 187/359
2013/0248298 A1 * 9/2013 Osmanbasic ..... B66B 5/20 187/359
2015/0298937 A1 * 10/2015 Rieser ..... B66B 5/20 187/359
2015/0321883 A1 * 11/2015 Husmann ..... B66B 5/20 187/374
2016/0311652 A1 * 10/2016 Osmanbasic ..... B66B 5/0093

FOREIGN PATENT DOCUMENTS

EP 1048602 A1 11/2000
EP 2112116 A1 10/2009
WO 2012080104 A1 6/2012

* cited by examiner

BRAKE DEVICE FOR A TRAVEL BODY OF AN ELEVATOR SYSTEM

FIELD

The invention relates to a safety brake and to a method for braking and fixing a travel body of an elevator installation by means of the safety brake, when required, as well as to an elevator installation with a safety brake of that kind.

BACKGROUND

Elevator installations are installed in buildings and usually consist of, inter alia, an elevator car which is held by a support device. The elevator car is movable by means of a drive in an upward direction, i.e. substantially opposite to the action of gravitational force, or in a downward direction, i.e. substantially in the direction of action of the gravitational force, for transport of persons and/or goods. The movement of the elevator car, also termed travel body, takes place substantially in vertical direction.

Known elevator installations of that kind frequently comprise safety brakes in order, in the case of failure of the drive or the support device, to secure this or also to safeguard against unintended drifting away or dropping down.

A safety brake comprising an eccentrically constructed brake body is known from EP 2 112 116 A1. The brake body is arranged in a housing. In operation, the housing together with the brake body is so displaced that the brake body bears against a brake rail and is pivoted by the relative movement between brake body and brake rail. Brake regions of the brake body are thereby positioned at the brake rail so that braking of the travel body takes place. In order to achieve the braking action a counter-braking plate for setting the braking force is arranged in the housing.

In addition, WO 2012/08104 A1 discloses a safety brake with a pivotable entraining body for actuation of the safety brake on contact with a brake rail by relative movement between entraining body and brake rail.

There is a need to design more reliably and to constructionally simplify the positioning of the brake body relative to the brake rail and/or a guide rail of the travel body. In addition, there is a need to similarly constructionally simplify and to design more reliably the restoration of the safety brake from a braking position to a rest position in which the safety brake does not exert a braking action.

SUMMARY

It is therefore an object of the present invention to avoid the disadvantages of the prior art. In particular, a device and a method of the kind stated in the introduction shall be provided by which braking and fixing of the travel body of an elevator installation can take place reliably. In addition, the safety brake shall be constructionally simple. Moreover, it is, in particular, an object to ensure a reliable and economic design of the equipment for resetting the safety brake into the rest position in which no braking action is exerted.

The safety brake for an elevator installation with at least one travel body, which is arranged to be movable along a guide rail and/or a brake rail in an elevator shaft, is suitable for braking and fixing the travel body at the guide rail and/or at a brake rail when required. The safety brake comprises a support for mounting a brake body and a control plate for positioning the brake body relative to the guide rail and/or the brake rail. The brake body is of at least two-part construction and comprises a first brake element and a second brake element. The two brake elements are movable substantially independently of one another at least in sub-regions. The first brake element is designed substantially only for braking and fixing in the case of movement of the travel body along the guide rail and/or the brake rail in an upward direction. The second brake element is designed substantially only for braking and fixing in the case of movement of the travel body along the guide rail and/or the brake rail in a downward direction. The control plate can also be termed base plate since it is constructed for holding the brake elements in a basic position. These terms are, in this connection, equivalent.

The two brake elements can, when required, together be brought into contact with the guide rail and/or the brake rail or adjusted relative thereto. Depending on the travel direction of the brake body, due to a friction couple between brake body and guide rail and/or brake rail the corresponding brake element is necessarily entrained and brought into an end or second braking position.

This has the advantage that the brake body is adaptable in simple manner to the respective requirements for braking force for the upward direction and/or downward direction, which makes operation of the brake more reliable and also more economic. It is possible, for example, in the case of corresponding wear of a brake element to exchange only this if the wear of the brake elements of the brake body is different for the different directions. Thus, operation of the safety brake in a given case is more economic by comparison with previously known safety brakes. In addition, the need for space of the safety brake can be optimized, since the brake element needed can be moved independently of the other brake element.

In particular, the device comprises a counter-braking body which is so arranged that the guide rail and/or the brake rail can be clamped between the brake body and the counter-braking body for generating a braking action. The braking force can in that case be set, inter alia, by the force applied by the counter-braking body to the guide rail and/or brake rail. For example, the counter-braking body can be formed with plate springs by which the effective braking force is settable. Through adjustment of the brake elements relative to the guide rail or brake rail the support is preferably so displaced together with the counter-braking body that the guide rail or brake rail is clamped between the brake body and the counter-braking body.

The control plate or base plate is preferably positionable in a rest position and a braking position. The positioning can be effected by means of a linear movement and/or pivot movement of the control plate. For example, the control plate can thus be positioned from the rest position into the braking position by means of a linear movement, a pivot movement or a combination of linear movement and pivot movement. In addition, the positioning of the control plate from the braking position back into the rest position can analogously take place by means of linear movement, pivot movement or a combination of linear movement and pivot movement.

This has the advantage that, for the purpose of actuation of the safety brake, only the control plate is positioned in the support, whereby it moves the brake body into a first braking position or adjusts it relative to the rail. Thus, actuation of the safety brake can take place in dependently of travel direction and for the purpose of actuation, for example, the entire housing of the safety brake does not have to be displaced. This makes construction of the safety brake, particularly the actuating equipment thereof, simpler and more economic by comparison with the prior art. In addition, a linear movement or also a pivot movement of merely the control plate from the rest position to the braking position and conversely can be realized in constructionally simple and reliable manner.

The control plate can preferably be held in the rest position by means of an electromagnet which is, in particular, able to be switched off. This has the advantage that a construction of that kind can be realized in simple manner and is thus economic. Moreover, it can be ensured that, for example, in the event of power failure the electromagnet is switched off, whereby a braking action of the safety brake is triggered, which enables operation of the safety brake as an emergency brake. Obviously, emergency power supplies, for example a battery or a capacitor, can be provided so as to bridge over temporary power interruptions. Emergency power supplies of that kind are then obviously incorporated in a safety or control concept of the elevator installation.

As an alternative to use of an electromagnet, which can, in particular, be switched off, for holding the control plate in the rest position the use of a mechanical locking device such as a gripper or a pin is also conceivable. This can be releasably connected with the control plate so that the control plate is movable from the rest position to the braking position.

The control plate is preferably movable into the braking position by means of a compression spring. This has the advantage that the control plate is reliably movable, for example, in the case of power failure, from the rest position to the braking position by exertion of a force on the control plate by the at least one compression spring in the direction of the braking position.

As an alternative to use of a compression spring for positioning the control plate from the rest position to the braking position the positioning can also be effected by means of a hydraulic, pneumatic or electrical drive, such as known to the expert. In addition, the use of, for example, a tension spring is also conceivable.

The first brake element and/or the second brake element is or are preferably pivotable. In particular, the first brake element and/or the second brake element is or are pivotable, particularly in opposite directions, about a common axle preferably arranged in or at the support. This has the advantage that through the positioning of the control plate and a corresponding pivotation of the brake elements these can be brought into contact with the guide rail and/or brake rail. This can be realized in constructionally simple manner, reliably and economically, since there is no need for complicated equipment for positioning the safety brake. In addition, advantageously the initial forces necessary for actuation of the brake elements are low, since in each instance only the individual brake elements are pivoted. In addition, dimensioning of the safety brake can be optimized since the brake elements are arranged parallel to one another on the same axle. Constructional height is accordingly minimal.

The two brake elements or the first brake element and the second brake elements are preferably so coupled together that they can rotate freely relative to one another within a predetermined displacement angle. A brake device can thus automatically set itself only on the basis of a travel direction.

The first brake element and/or the second brake element is or are preferably so pivotable from the basic position into a first braking position that the first brake element and/or the second brake element is or are in contact with the guide rail and/or the brake rail.

In the sense of the present invention substantially no braking or fixing takes place if the first brake element and/or the second brake element is or are in the first braking position in contact with the guide rail and/or the brake rail.

For preference, the first brake element and/or the second brake element is or are pivotable from the first braking position to a second braking position by friction couple with the guide rail.

This has the advantage that by means of a simple pivot movement of at least one brake element, which is in contact with the guide rail and/or brake rail, this can be brought from the first braking position to a second braking position, which can be realized in constructionally simple manner. By virtue of the relative movement between guide rail and/or brake rail and the corresponding brake element a further pivotation of the brake element can now take place, whereby the braking action of the safety brake is enhanced. In that regard, it is particularly advantageous that this further pivotation is directly dependent on the direction of the relative movement. This direction is thus decisive with regard to which of the two brake element is pivoted into the final, second braking position. A braking force for downward travel and upward travel can thus be individually predetermined by means of the form of the brake elements.

In particular, release of the safety brake by return pivotation of the first brake element and/or the second brake element through friction couple with the guide rail and/or the brake rail from the second braking position to the first braking position can take place. This corresponds with, in particular, an opposite relative movement with respect to the relative movement for pivotation of the corresponding brake element from the first braking position to the second braking position. This has the advantage that release of the safety brake by pivotation of the corresponding brake element from the second braking position to the first braking position can be effected in constructionally simple and reliable manner, since, for example, additional resetting equipment is not necessary. The corresponding brake element can be brought from the first brake position into the basic position by appropriate return pivotation.

The control plate is preferably movable from the braking position to the rest position by pivotation of the first brake element and/or the second brake element from the first braking position to the second braking position. In other words, through pivotation of one of the brake elements from the first braking position to the second braking position the control plate is moved back from the braking position to the rest position.

This has the advantage that on the one hand the first and/or second brake element is or are moved into the first braking position by positioning of the control plate from its rest position to the braking position. On the other hand, through the subsequent further movement, which is produced by friction couple with the guide rail and/or the brake rail, of the first brake element or the second brake element the control plate is moved back from its braking position to the rest position. In the basic position the control plate can be held again by means of the locking device. The locking device can be constructed as, for example, an electromagnet which can be switched off. The electromagnet thus holds the control plate in the rest position. When required, the electromagnet is switched off and the control plate is displaced into the braking position, in which case it moves the brake elements into the first braking position. Depending on the travel direction of the travel body the corresponding brake element is moved into the second braking position, whereby the guide rail or brake rail is clamped and the travel body braked. At the same time, on displacement of the corresponding brake element from the first to the second braking position, the control plate can, as described, be moved back relative to the electromagnet. This is particularly advantageous, since now for holding the control plate in the rest position merely the electromagnet can be switched on. No further restoring energy is needed, which further simplifies the constructional design of the safety brake and makes this less expensive.

The first brake element or the second brake element preferably entrains the other one of the two brake elements after pivotation through the predetermined displacement angle. Advantageously, in that case this other one of the two brake elements is rotated back substantially into its basic position, whereby at the same time this other one of the two brake elements moves or urges the control plate back from the braking position into the rest position. The control plate is thereby again disposed in its rest position and the locking device can again simply hold the control plate.

For preference, the first brake element or the second brake element comprises an entrainer and the other one of the two brake elements comprises an entraining guide. The entrainer, for example, a pin arranged in the first brake element, projects into the entraining guide of the other one of the two brake elements. The entraining guide is in that case, for example, a curved slot in the second brake element, wherein the curve length is formed in correspondence with the predetermined displacement angle. The two brake elements can thus freely rotate relative to one another within the dimensions of the entraining guide or within the predetermined displacement angle. The other one of the two brake elements can thus be pivoted back into its rest position by drawing in the first or second brake element, whereby the control plate is also moved back into the rest position in simple mode and manner.

The first brake element and/or the second brake element is or are preferably constructed as an eccentric disc. This advantageously makes possible a compact and simple mode of construction of the safety brake.

By eccentric disc there is understood in the sense of the present invention a disc with any desired external profile, which is mounted to be pivotable about an axis outside the geometric center point. For example, an appropriately mounted cam disc can be an eccentric disc in the sense of the present invention.

The eccentric disc is preferably curved in a section on the side facing the guide rail and/or the brake rail. In particular, the section in contact with the guide rail and/or the brake rail in the first braking position is curved. With particular preference the radius of the eccentric disc increases referred to the direction of the pivotation from the first to the second braking position. This has the advantage that through the friction couple between eccentric disc in curved region and the guide rail and/or brake rail the eccentric disc is reliably pivotable into the second braking position for achieving the desired braking action.

The eccentric disc is preferably planar in a section on the side facing the guide rail and/or the brake rail. In particular, that section is planar which in the second braking position is in contact with the guide rail and/or the brake rail. This has the advantage that a largest possible contact area between eccentric disc and guide rail and/or brake rail is made possible for achieving a high level of braking action by the safety brake.

In particular, the eccentric disc has a first curved section and a second planar section. The safety brake can be clamped over the region of the first curved section and on reaching the second, planar section the largest possible contact area for braking is available. At the same time, through the planar area a further rotation of the eccentric disc can be stopped. As an alternative, obviously also a continuously curved eccentric disc can be used. In that regard, the braking position can be defined by an abutment which prevents further rotation of the eccentric disc. This alternative can be of advantage in the case of small loads or low speeds, since brake loading is low in correspondence with the small load or a small brake travel.

The eccentric disc is preferably so formed on the side remote from the guide rail and/or brake rail that through pivotation, in particular from the first braking position to the second braking position, of the eccentric disc a restoring force can be exerted on the control plate for movement of the control plate into the rest position.

The control plate preferably has a contact surface or control dogs of such a kind that on movement of the control plate into the braking position the eccentric disc is pivotable into the first braking position and the restoring force can be exerted on the control plate on pivotation of the eccentric disc into the second braking position, or the restoring force on the control plate during pivotation is effected by entrainment of the eccentric disc.

This design of eccentric disc and control plate has the advantage that restoration of the control plate to the rest position on pivotation of the eccentric disc into the second braking position is achievable by mechanical interactions between eccentric disc and control plate.

For example, the outer surface of the eccentric disc can, in the second braking position, have a greater spacing starting from the pivot axis on the side facing the guide rail and/or brake rail than on the side remote from the guide rail and/or brake rail. The remote side of the eccentric disc in that case presses on the control plate. As a result, a compact mode of construction of the safety brake can advantageously be achieved. The movement of the control plate into the rest position can be achieved through appropriate design of the profile of the control plate which interacts with the eccentric disc. As contact area, the control plate can have on the side facing the eccentric disc, for example, a wedge-shaped surface or be provided with control dogs with which the side of the eccentric disc remote from the guide rail and/or brake rail can co-operate. As a result, on pivotation of the eccentric disc into the second braking position the control plate is correspondingly moved into the rest position.

In particular, the wedge-shaped surface of the control plate is so designed for each brake element that a desired pivotation into the first braking position of the first and second braking elements can take place. For example, the wedge-shaped surface for the first brake element can be arranged in a first direction and for the second brake element in a second direction substantially opposite to the first direction.

The safety brake preferably has a first braking area of the first brake element smaller than a second braking area of the second brake element. In particular, the braking area of the first brake element is at most 75% and more particularly at most 60% of the second braking area. In particular, the first brake element has a first braking area corresponding with approximately 50% of the second braking area of the second brake element.

This has the advantage of an economic design of the safety brake, since in the case of braking of the travel body in an upward direction lower braking forces than in the case of braking in downward direction are needed. That can be realized by appropriate adaptation of the braking areas of the first brake element and the second brake element.

In particular, the braking area of the brake elements is formed by the planar section of the eccentric discs.

For preference the braking area is determined by the thickness of the brake elements and, in particular, the eccentric discs. For example, the thickness of the first brake element can be 50% of the thickness of the second brake element, whereby the first braking area is 50% of the second braking area.

The second brake element preferably comprises two brake parts with, in particular, substantially the same braking area, wherein the first brake element has a first braking area substantially equal to one of the brake parts of the second brake element. This has the advantage that, for example, identical brake parts are usable for braking in upward direction and downward direction and that in each instance only the number of brake parts has to be selected for the corresponding direction. This simplifies handling and, in addition, stock-keeping is simplified, since the same brake parts are usable, which is more economic. For example, the brake parts can be constructed as eccentric discs or other brake discs.

In particular, the first brake element is arranged between the two brake parts of the second brake element. This has the advantage that the stability and braking action of the safety brake is improved, which makes the safety brake more reliable in operation.

For preference, at least one sensor for position monitoring and/or state monitoring at least of the first brake element, the second brake element or the control plate or any combinations thereof is arranged at and/or in the safety brake. This has the advantage that, for example, wear or occurrence of faulty functions can be recognized in good time, which makes operation even more reliable. The elevator installation can, for example, be automatically stopped if the control plate leaves its rest position.

The "state monitoring" can, in an appropriate embodiment, be used, inter alia, for monitoring the wear of the brake elements, the braking forces which arise and also the speed of pivotation of the brake elements or any combinations thereof.

The first brake element and/or the second brake element are preferably biased in the direction of the control plate. In particular, the biasing is effected by means of at least one spring. This has the advantage that in the rest position of the control plate it is ensured that the brake elements are not unintentionally pivoted in the direction of the guide rail and/or brake rail and the safety brake unintentionally triggered. The spring can be executed as a tension spring, which biases the first brake element and the second brake element in the direction of the basic position. Instead of tension springs, helical springs or a magnetic retraction system is or are possible.

A further aspect relates to an elevator installation comprising a safety brake as described in the foregoing.

An additional aspect relates to a method for braking and fixing a travel body of an elevator installation by means of a safety brake when required. In particular, use is preferably made of a safety brake as described above. The safety brake comprises a control plate for positioning the brake body relative to the guide rail and/or the brake rail. The brake body comprises a first brake element and a second brake element. The first brake element is designed substantially only for braking in the case of movement of the travel body along the guide rail in an upward direction. The second brake element is designed substantially only for braking in the case of movement of the travel body along the guide rail in a second, downward direction opposite to the upward direction. The method comprises the step of braking and/or fixing the travel body by positioning of the first and/or second brake element at the guide rail and/or brake rail. In that case, the first brake element and the second brake element are preferably adjusted by means of the control plate with respect to the guide rail or brake rail and brought into a first braking position. On movement of the travel body along the guide rail in the upward direction the first brake element is brought, independently of the second brake element, from the first braking position to a second braking position. Conversely, on movement of the travel body along the guide rail in a downward direction the second brake element is brought, independently of the first brake element, from the first braking position to the second braking position.

In one application, a safety brake of that kind is used for equipping and/or re-equipping an elevator installation. This includes the step of installing a safety brake as described above at and/or in the elevator installation for producing an elevator installation as described above.

DESCRIPTION OF THE DRAWINGS

Further features and advantages of the invention are explained in more detail in the following by way of embodiments for better understanding and without restricting the invention to the embodiments, wherein.

DETAILED DESCRIPTION

Figure 1:
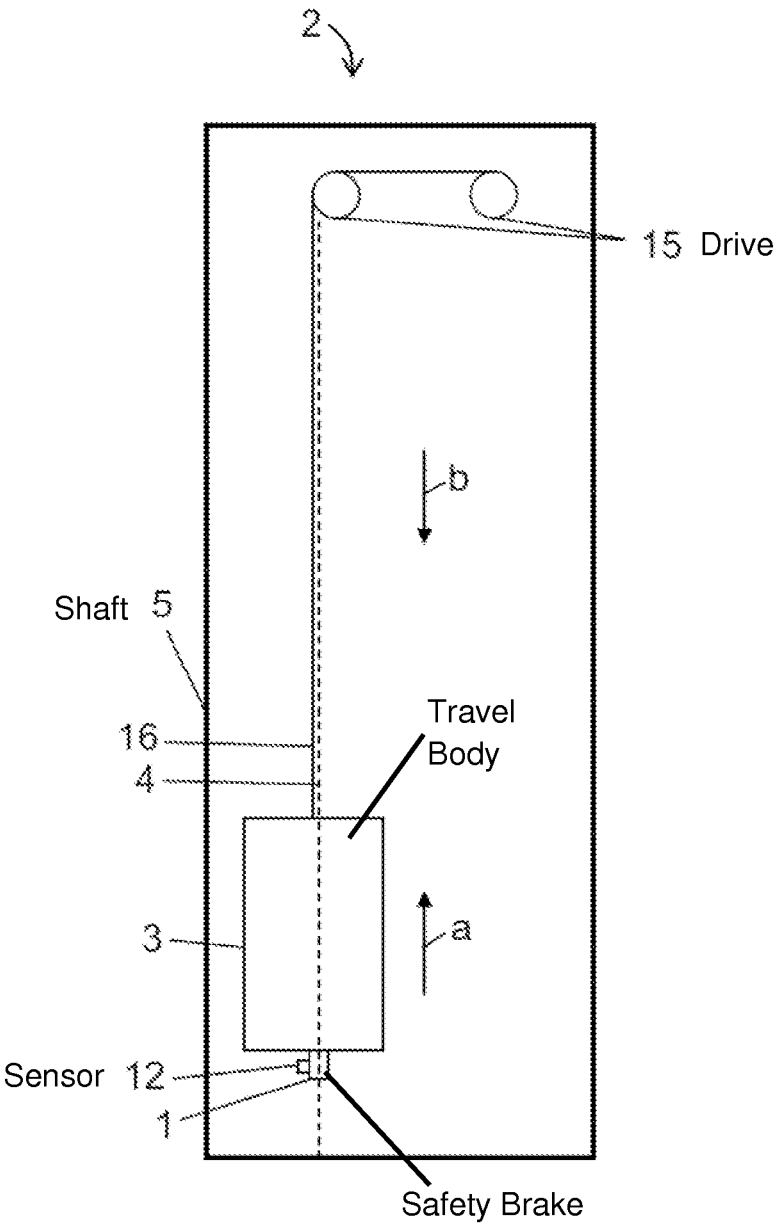
FIG. 1 shows a schematic illustration of an elevator installation with a safety brake according to the invention.

An elevator installation 2 with a travel body 3 comprising a safety brake 1 according to the invention for braking and fixing the travel body 3 when required is shown in FIG. 1 in schematic illustration. The elevator installation 2 comprises an elevator shaft 5 in which a guide rail 4 is arranged, along which the travel body 3 is movable in an upward direction a or a downward direction b. The travel body 3 is suspended in the elevator shaft 5 by means of support equipment 16 formed by cables. Movement of the travel body 3 in the upward direction a and/or the downward direction b is possible by means of a drive 15, which is in operative connection with the travel body 3 by way of the support equipment 16. In the case of the illustrated elevator installation 2 the travel body 3, frequently an elevator car, is supported to the full extent by the drive 15. As a rule, a further travel body, in the form of a counterweight, is disposed in the elevator shaft, which moves oppositely to the travel body 3 and which is correspondingly fastened to the opposite end of the support equipment 16.

The safety brake 1 mounted on the travel body 3 is constructed so that when required, such as, for example, a failure of the support equipment 16 or in the case of power failure, the travel body can be braked and fixed. For this purpose a braking action is achieved by the safety brake 1 in interaction with the guide rail 4. The guide rail 4 can, in a given case, also be constructed as a brake rail. Alternatively, the arrangement of a brake rail additionally to the guide rail is also conceivable in order to, for example, brake the travel body 3 only in specific sections in the elevator shaft 5 by means of the safety brake 1. A sensor 12 for position monitoring and/or state monitoring of the safety brake 1 is arranged at the safety brake 1. The braking action of the safety brake 1 can, for example, be compared by the sensor 12 with a target value, whereby a state monitoring of the safety brake can be achieved. The sensor 12 can obviously also be arranged at a different location on the travel body. The sensor 12 can also be merely a switching element which monitors a working setting of the safety brake and, for example, stops the elevator installation if the safety brake is actuated.

From here on and in the following, the same reference numerals are used for the same features in all figures and accordingly are explained again only when required.

A side view of the safety brake 1 according to the invention is schematically illustrated in FIGS. 2 to 7 in sequentially successive operational states. For better understanding, the safety brake 1 is illustrated in co-operation with the guide rail 4, although the guide rail 4 is not a component of the safety brake 1.

The safety brake 1 comprises a support 22. The support 22 forms a housing-like load-bearing structure for absorption of clamping forces of the safety brake device. An axle 9 is fixedly arranged in the support 22. In addition, the safety brake 1 includes a two-level brake body, comprising a first brake element 7 and a second brake element 8. The two brake elements are constructed as eccentric discs and pivotably arranged on the common axle 9. A control plate 6 is arranged in or at the support 22 to be displaceable between a rest position r and a braking position e. The control plate 6 has a surface 19 as an outer contact area. The surface 19 interacts with the brake elements 7, 8. In addition, an electromagnet 17 and compression springs 18 are arranged in the support 22. The electromagnet 17 holds the control plate 6 in the rest position r against a force of the compression springs 18. Moreover, a spring 23 resiliently draws the second brake element 8 against the control plate 6 or against the surface 19 of the control plate 6. The second brake element 8 is thus disposed in the basic position g. Analogously, the first brake element 7 is held by a spring (not illustrated) in the basic position g.

A counter-braking body 13 is arranged on or in the support 22 on the side of the guide rail 4 remote from the first and second brake elements 7, 8. The counter-braking body 13 is supported in the support 22 by means of plate springs 14 and can be pressed against the guide rail 4 so that a braking action is achievable by the safety brake 1. A pressing force of the brake body 13 against the guide rail 4 is settable by, for example, selection of the bias of the plate springs.

The first brake element 7 has a first braking area 10 and is disposed in the basic position g. The second brake element 8 has a second braking area 11 and is similarly disposed in the basic position g. The braking area 11 is larger than the braking area 10, which, however, is not evident in FIGS. 2 to 6.

The arrow denoted by b characterizes the relative movement between the travel body, at which the safety brake 1 is arranged, and the guide rail 4. The travel body is moved in downward direction b, which is illustrated in FIGS. 2 to 6 as movement of the guide rail 4. Thus, a co-ordinate system fixed relative to the safety brake 1 has been selected.

Figure 2:
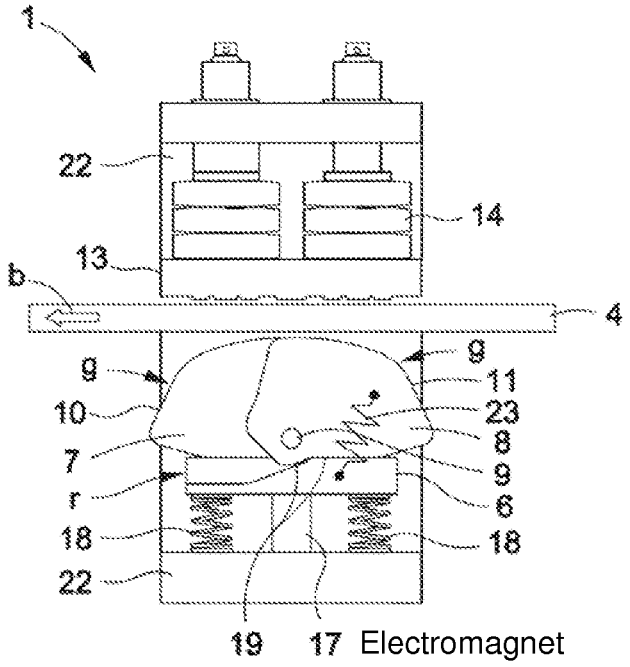
FIGS. 2 to 7 show schematic illustrations of a safety brake according to the invention in sequential operational states.

The control plate 6 is disposed in FIG. 2 in the rest position r and is held by means of the electromagnet 17, which can be switched off, in the rest position r. In addition, arranged at the control plate 6 are the compression springs 18 by means of which after switching-off of the electromagnet 17 the control plate 6 is movable into a braking position s (shown in FIG. 3). The braking elements 7, 8 and also the counter-braking body 13 have a gap relative to the guide rail 4 so that the travel body is freely movable along the guide rails.

Figure 3:
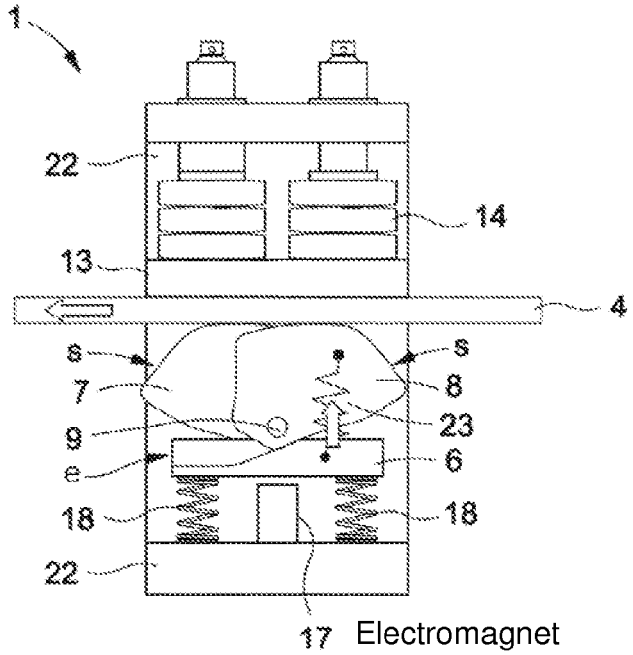

The safety brake 1 is illustrated in FIG. 3 in a first operating state in which the electromagnet 17 is switched off and the control plate 6 has been brought by means of the compression springs 18 into the braking position e. Through co-operation of the wedge-shaped surface sections of the surface 19 of the control plate 6 and a rear-side shape of the first brake element 7 and the second brake element 8 the two brake elements 7, 8 are pivoted in opposite directions about the axle 9. A respective curved region of each of the brake elements 7, 8, which are constructed as eccentric discs, is thereby brought into contact with the guide rail 4. The two brake elements 7, 8 are now disposed in a first braking position s. They are pressed against the guide rails by a pressing force determined by the compression springs 18.

Figure 4:
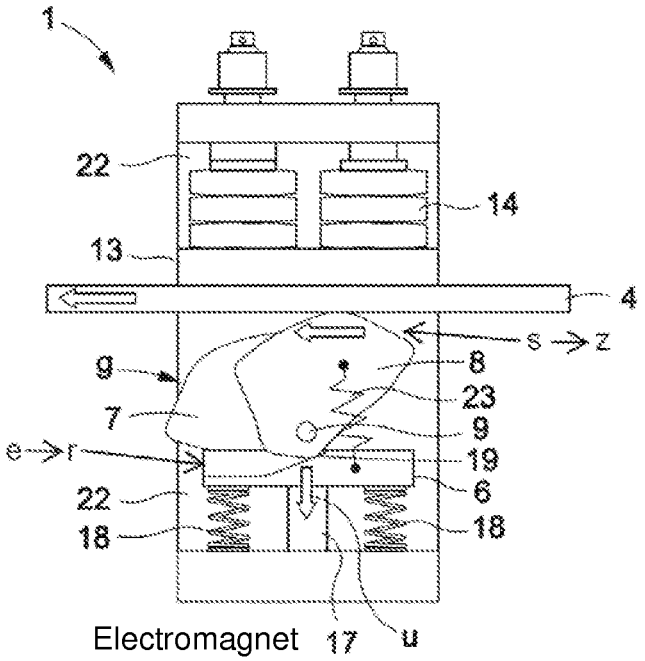

As illustrated in FIG. 4, one of the two brake elements 7, 8 is further pivoted through the contact between guide rail 4 and two brake elements 7, 8 by means of friction couple by way of the relative movement of the guide rail 4. In the example, depending on the direction of the relative movement the second brake element 8 is further pivoted. In that case due to the shape of the brake elements similar to eccentrics the first brake element 7 loses contact with the guide rail 4 and it is drawn back by its spring (not illustrated) towards the control plate. Due to the shape and arrangement of the second brake element 8 and the surface 19 of the control plate 6 the control plate 6 is simultaneously moved back in direction u into the rest position e.

Figure 5:
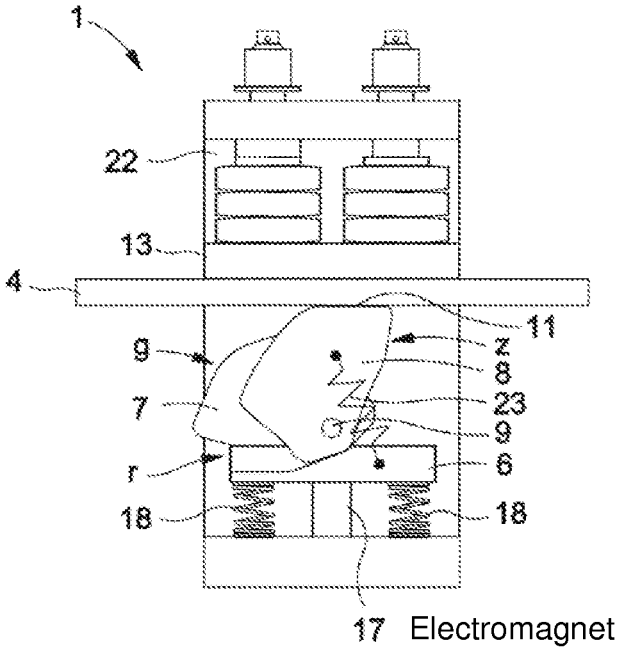

In FIG. 5 the pivotation of the second brake element into a second braking position z is concluded, whereby the second braking area 11 has been brought into contact with the guide rail 4. The brake element 8 has during the clamping in the second braking position z drawn the support 22 together with the counter-braking lining 13 towards the guide rail and stressed the plate springs 14 so that a desired braking force could be built up. The brake elements 7, 8 are preferably provided with end abutments relative to the support 22 so that further rotation of the brake elements 7, 8 on reaching the second braking position z is prevented.

In addition, during the clamping of the second brake element 8 in the second braking position z the control plate 6 was moved into the rest position r and is again in contact with the electromagnet 17. The compression springs 18 are biased again. The electromagnet 17 is arranged to be yielding substantially parallel to the action of the restoring force u so that bridging-over is made possible in order to guarantee contact between control plate 6 and electromagnet 17 during resetting.

Figure 6:
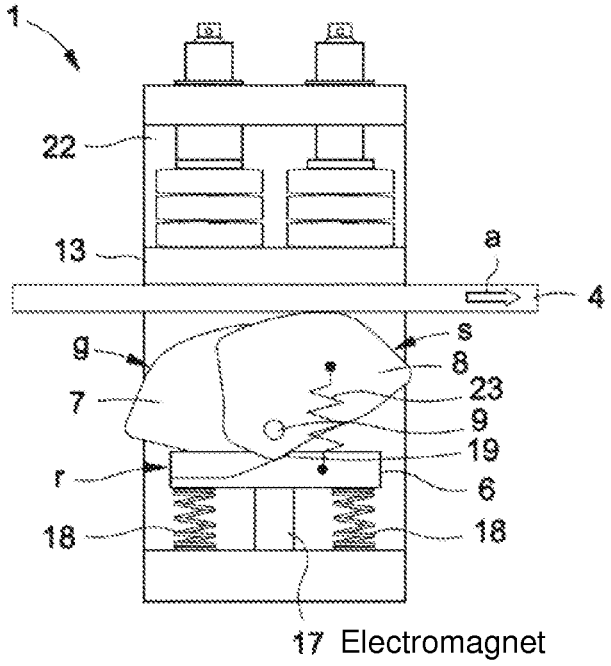

As illustrated in FIG. 6, after braking or fixing of the travel body by means of the safety brake 1 the travel body is moved in an upward direction a, which is also here illustrated by a movement of the guide rail 4. As a result, resetting of the second brake element 8 into the first brake position s and thus release of the safety brake 1 take place. The electromagnet 17 is switched on at the latest on reaching the first braking position s or, better, already beforehand so as to hold the control plate in the rest position r.

Figure 7:
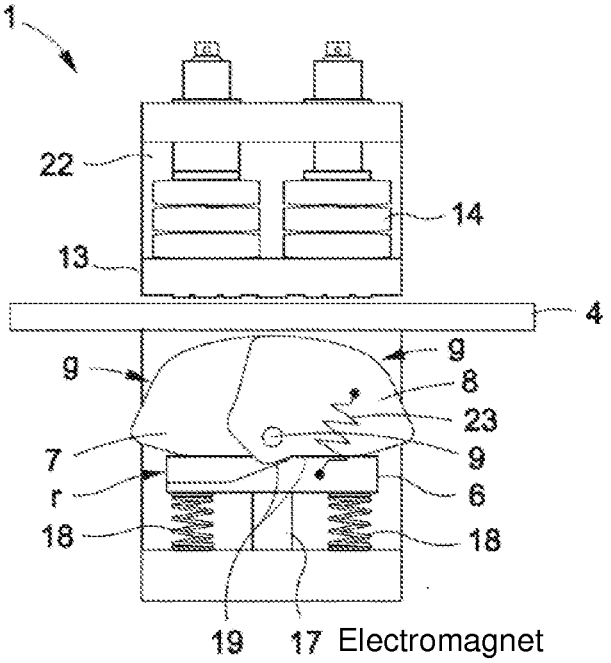

As illustrated in FIG. 7, the second braking element 8 is pivoted back into the basic position g, which can be achieved by the spring 23. The safety brake is again reset into its original position in correspondence with FIG. 2.

Figure 8:
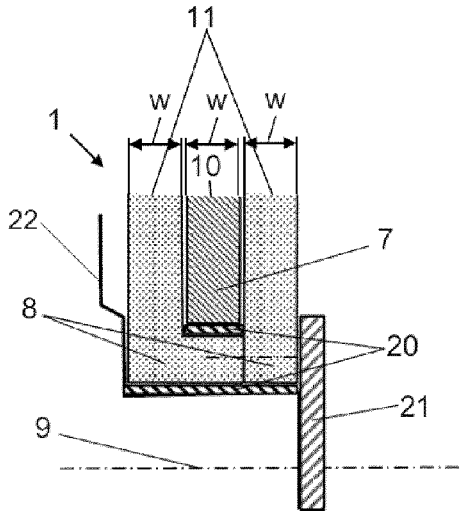
FIG. 8 shows a sectional side view of a brake body of the safety brake according to the invention.

A detail of the safety brake 1 is illustrated in FIG. 8 in a sectional illustration through the axle. The axle 9 is executed as a component of the support 22. In addition, the first brake element 7 and the second brake element 8 are again arranged at the axle 9. The two brake elements 7, 8 are mounted, multi-level, on the axle 9 by means of a fastening disc 21. The first brake element 7 has a first braking area 10, which is approximately 50% of the second braking area 11 of the second brake element 8. The first brake element 7 is arranged between the two brake parts of the second brake element 8. The brake parts all have a thickness w of 9 to 12 millimeters. The axle 9 is dimensioned in order to take over the clamping forces arising on clamping of the brake element 7, 8 in the second braking position.

The safety brake 1 additionally comprises slide bearings 20, by means of which the brake elements are pivotable as described in the foregoing.

A further detailed embodiment of a safety brake 1 according to the invention is illustrated again in sequentially successive operational states in FIGS. 9 to 12. Equivalent parts are also provided in these figures with the same reference numerals as were used in the preceding figures. The safety brake 1 is illustrated in the figures without guide rail 4. The safety brake 1 again comprises the support 22, which forms the housing of the safety brake and which is designed to transmit resultant braking forces to the travel body of the elevator installation. The support 22 is of multi-part construction in the example. Arranged at the support 22 is the axle 9 serving for mounting of the first brake element 7 and the second brake element 8. The two brake elements 7, 8 are pivotably mounted on the axle 9 by way of suitable bearing elements, preferably a slide bearing bush, and secured against slipping laterally. The two brake elements are arranged parallel and adjacent to one another. In this embodiment the first brake element 7 includes a curved recess forming an entraining guide 25. An entrainer 26, which is in the form of a pin and which protrudes into the entraining guide 25 of the first brake element, is arranged in the second brake element 8. In the example the entraining guide 25 is so dimensioned that the two brake elements can be rotated relative to one another through an appropriately predetermined displacement angle 27 of approximately plus/minus 90 degrees. The size of the predetermined displacement angle 27 results from the design of the brake elements 7, 8. In the present case a rotational angle of the brake elements 7, 8 from the basic position g to the second braking position z is approximately 90 degrees, whereby also the size of the predetermined displacement angle 27 is determined. The two brake elements 7, 8 are drawn by a spring mechanism (not illustrated) towards the control plate 6. The control plate 6 includes a first control dog 67, which co-operates with a back surface of the first brake element 7, and it includes a second control dog 68, which co-operates with a back surface of the second brake element 8. The control plate 6 is held by the electromagnets 17 in the rest position r by way of a corresponding magnet retaining plate 17.1 against the force of the compression springs 18. The sensor 12, in the form of a switch, monitors the rest position of the control plates 6 and thus an operational state of the safety brake.

The counter-braking body 13 is arranged on the side of the safety brake opposite the first and second brake elements 7, 8 on or in the support 22 again analogously to the preceding solution. The counter-braking body 13 is supported in the support 22 by means of plate springs 14. The guide rail 4 can be arranged and pressed between brake elements 7, 8 and the counter-braking body 13 so that a corresponding braking action by the safety brake 1 is achievable. The pressing force of the brake body 13 against the guide rail 4 is in that case settable by, for example, selection and setting of the bias of the plate springs.

Figure 9:
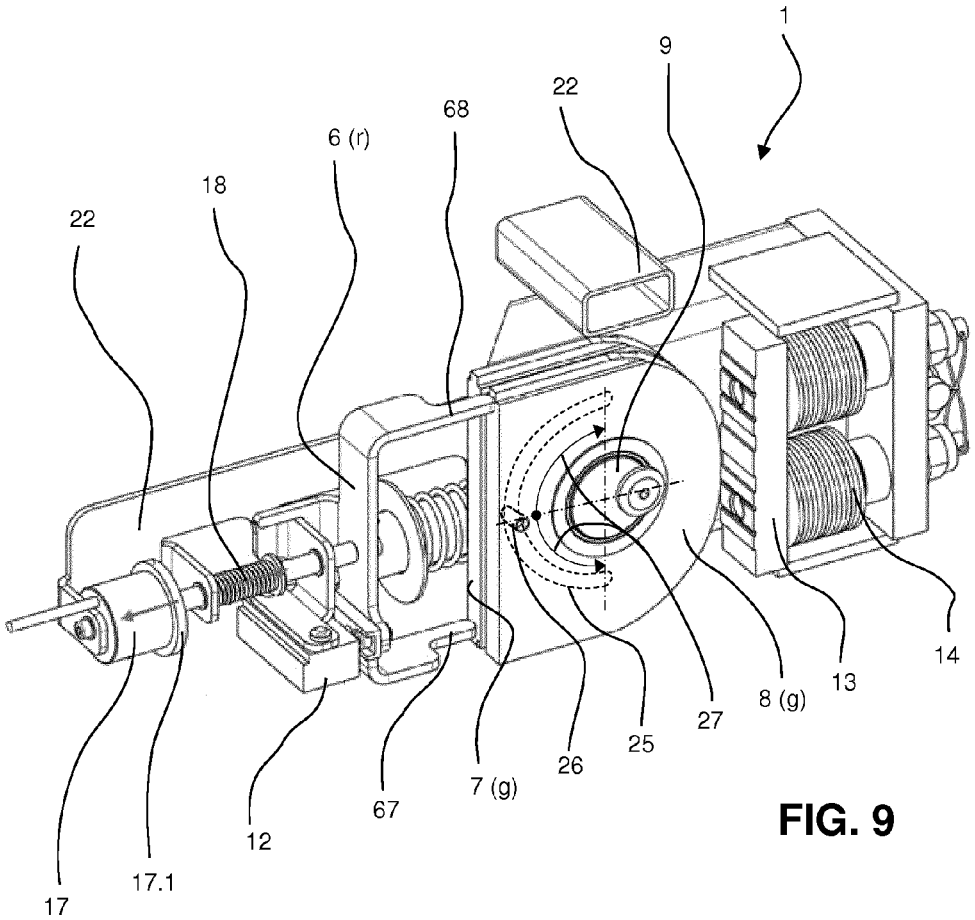
FIGS. 9 to 12 show perspective views of an embodiment of a safety brake according to the invention in sequential operational states.

In FIG. 9 the control plate 6 is disposed in its rest position r. The electromagnet is energized. The first brake element 7 is drawn by means of a spring mechanism (not illustrated) against the control dog 67 and the second brake element 8 is correspondingly drawn towards the control dog 68. The brake elements 7, 8 and the entire safety brake 1 are disposed in a basic position g so that the travel body would be freely movable along the guide rails. A gap relative to the counter-braking body 13 is appropriately large so that the guide rail can be arranged to be freely movable.

Figure 10:
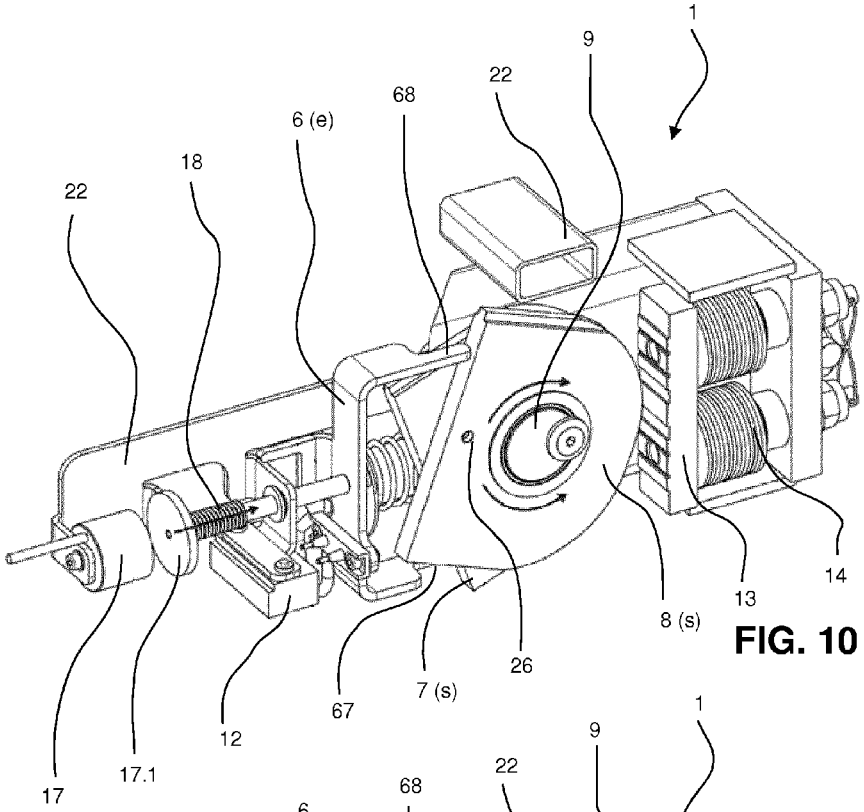

In FIG. 10 the electromagnet is switched to be free of current and the compression spring 18 urges the control cam 6 in the direction of the brake elements 7, 8. The first control dog 67 thereby rotates the first brake element 7 from the basic position g into the first braking position s and at the same time the second control dog 68 rotates the second brake element 8 from the basic position g into the first braking position s thereof. The rotation takes place until the brake elements 7, 8 have been rotated to such an extent that they can clamp the guide rail. The sensor 12 detects the adjustment of the control plate 6 and can give an appropriate signal to a control of the elevator.

Figure 11:
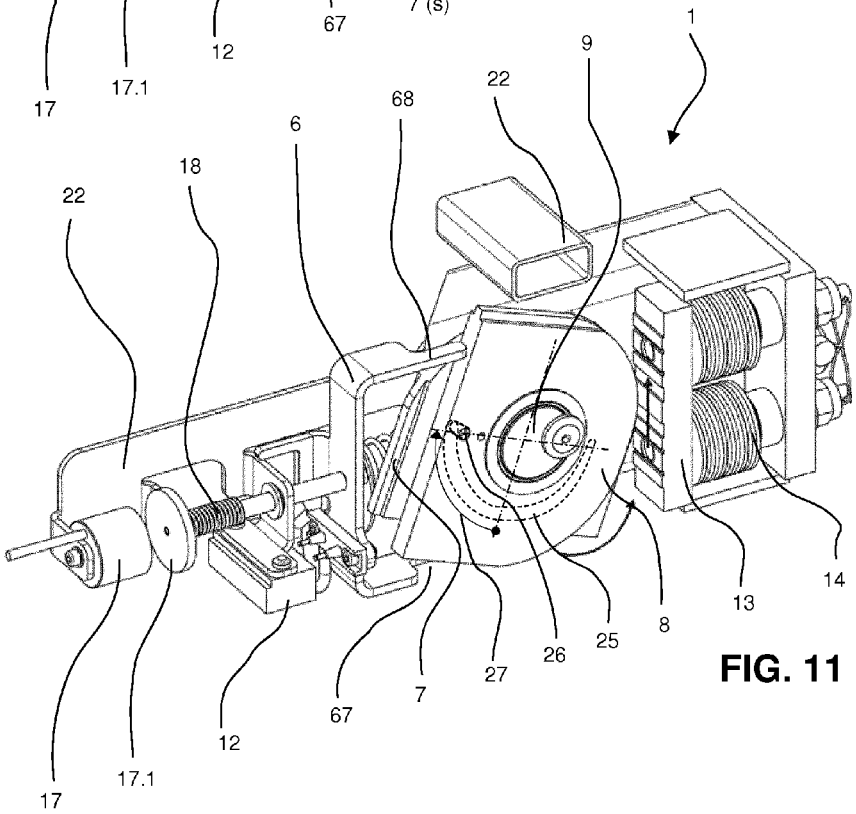

Due to the clamping of the brake elements 7, 8, in the case of an assumed downward movement of the safety brake in relation to a guide rail the first brake element 7 as apparent in FIG. 11 is now further rotated in counter-clockwise direction and it increasingly clamps the safety brake due to its preferably eccentric shape. The second brake element 8 remains in its first braking position s and slips over the travel path. The further rotation of the first brake element 7 takes place until in an intermediate position of the rotational angle between the two brake elements 7, 8 the predetermined displacement angle 27, which is determined by the co-operation of the entrainer 26 and the entraining guide 25, is reached. This state is apparent in FIG. 11.

Figure 12:
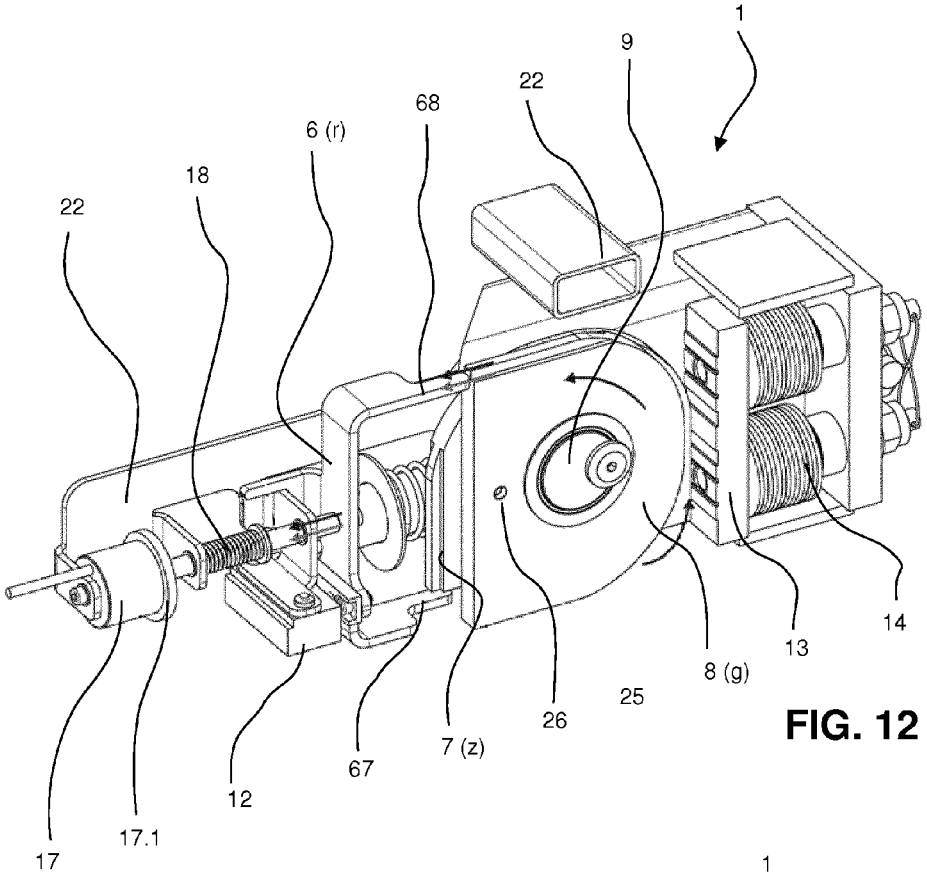
Figure 13:
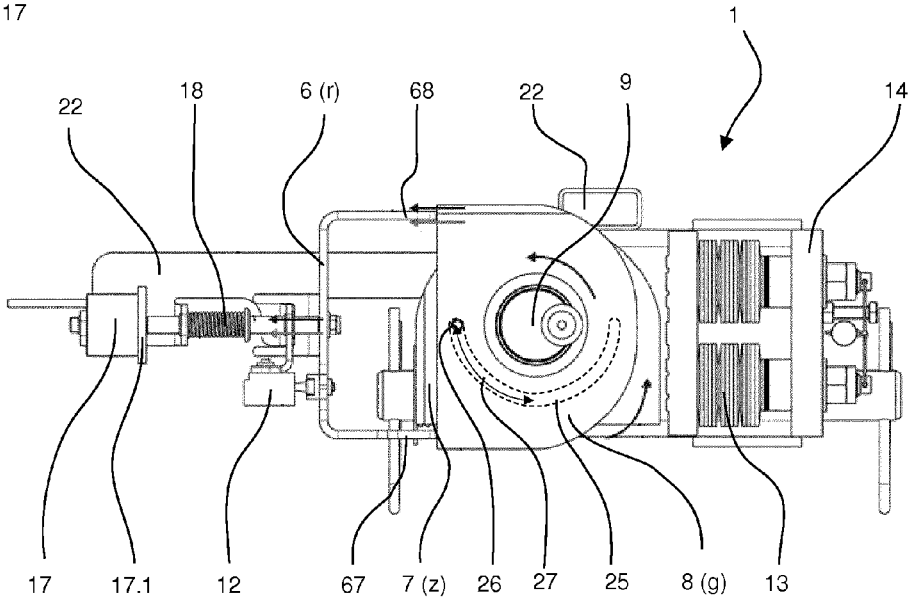
FIG. 13 shows a front view of the safety brake according to FIG. 12.

Through the further movement of the safety brake obviously the first brake element 7 is further rotated as illustrated in FIG. 12 until its substantially planar surface, which is formed as a braking surface, bears against the guide rail. The maximum working point or the second braking position z of the first brake element 7 is thus reached. In FIG. 13, which illustrates a front view of the safety brake in the working position according to FIG. 12, a gap between mating brake lining 13 and the brake surface of the first brake element is, as apparent, minimal. This means that a guide rail, which would be arranged in this intermediate space, would be clamped to the maximum extent as explained in the preceding FIGS. 2 to 7.

As apparent in FIGS. 12 and 13, the first brake element 7 entrains the second brake element 8 by means of entrainer 25 and entrainer guide 26 and rotates this back into the original basic position g. A rear side of the second brake element in that case urges the control plate 6 into its position corresponding with the rest position r. Whilst as a consequence the first brake element 7 by its clamping action relative to the guide rail and mating brake lining produces braking of the travel body, the control plate 6 is already brought by the electromagnet 17 into a position corresponding with the rest position r.

For resetting of the safety brake merely the electromagnet 17 can now be energized again and the safety brake 1 can be reset in a return movement as was explained in connection with FIG. 6.

The functions were explained in the preceding examples on the basis of one travel direction. Obviously the functional sequence is analogous for an opposite travel direction. Variations of plots of braking force are possible by different shaping of the brake elements 7, 8 in the form of eccentric discs or obviously the brake elements 7, 8 can be varied as explained, for example, in connection with FIG. 8.

Further details apparent in FIGS. 9 to 13 such as, for example, sealing devices for securing settings of the plate springs 14 correspond with usual forms of embodiment of safety brakes and are not further explained.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A safety brake for an elevator installation with a travel body movable along at least one of a guide rail and a brake rail in an elevator shaft, wherein the safety brake brakes and fixes the travel body at the rail when required, the safety brake comprising:

a brake body having a first brake element and a second brake element, wherein the first and second brake elements are movable independently of one another and the first brake element is for braking and fixing only in case of movement of the travel body along the rail in an upward direction and wherein the second brake element is for braking and fixing only in case of movement of the travel body along the rail in a downward direction an axle arranged at the brake body, the first brake element and the second brake element being pivotable about the axle; and wherein the first brake element and the second brake element are coupled together to be freely rotatable about the axle relative to one another within a predetermined displacement angle.

2. The safety brake according to claim 1 wherein one of the first brake element and the second brake element includes an entrainer that projects into an entraining guide formed in another one of the first and second brake elements to enable the first and second brake elements to freely rotate relative to one another through the predetermined displacement angle.

3. The safety brake according to claim 1 including a control plate for positioning the brake body relative to the rail, wherein the control plate is positionable in each of a rest position and a braking position by at least one of a linear movement and a pivot movement, wherein the control plate is held in the rest position by an electromagnet that is switched on, and wherein the electromagnet is switched off to enable the control plate to move into the braking position by a compression spring.

4. The safety brake according to claim 3 wherein the axle is arranged at a support and the control plate is arranged at the support for linear or pivotal movement to position the first brake element and the second brake element relative to the rail, wherein the first brake element and the second brake element are pivotable from a basic position to a first braking position where the first brake element and the second brake element are in contact with the rail.

5. The safety brake according to claim 4 wherein each of the first brake element and the second brake element are pivotable by friction couple with the rail from the first braking position to a second braking position and the control plate is movable from the braking position to the rest position by pivotation of the first brake element or the second brake element from the first braking position to the second braking position.

6. The safety brake according to claim 5 wherein the first brake element and the second brake element are coupled together to be freely rotatable about the axle relative to one another within a predetermined displacement angle, wherein the first brake element entrains the second brake element or the second brake element entrains the first brake element after pivotation through the predetermined displacement angle, and wherein the entrained one of the first and second brake elements is rotated back into the basic position and the control plate thereby moves from the braking position back into the rest position.

7. The safety brake according to claim 3 wherein the control plate has a first control dog that activates the first brake element and a second control dog that activates the second brake element.

8. The safety brake according to claim 3 including a sensor for at least one of position monitoring and state monitoring of at least one of the first brake element, the second brake element and the control plate.

9. The safety brake according to claim 3 wherein at least one of the first brake element and the second brake element is biased toward the control plate by at least one spring.

10. The safety brake according to claim 1 wherein at least one of the first and second brake elements is formed as an eccentric disc.

11. The safety brake according to claim 10 wherein the eccentric disc is curved in a section on a side facing the rail, the section being in contact with the rail in a first braking position of the eccentric disc, and the eccentric disc is planar in another section on the side facing the rail, the another section being in contact with the rail in a second braking position of the eccentric disc.

12. The safety brake according to claim 11 wherein the first braking area is at most 60% of the second braking area.

13. The safety brake according to claim 1 wherein the first brake element has a first braking area smaller than a second braking area of the second brake element.

14. The safety brake according to claim 13 wherein the first braking area is at most 75% of the second braking area.

15. The safety brake according to claim 13 wherein the second brake element includes two eccentric discs with a same braking area, wherein the first braking area of the first brake element is equal to the braking area of one of the eccentric discs, and wherein the first brake element is arranged between the two eccentric discs of the second brake element.

16. The safety brake according to claim 1 including a sensor for at least one of position monitoring and state monitoring of at least one of the first brake element and the second brake element.

17. An elevator installation having a travel body and a safety brake according to claim 1 arranged at the travel body.

* * * * *